US008097293B2

(12) United States Patent
Wöhr et al.

(10) Patent No.: US 8,097,293 B2
(45) Date of Patent: Jan. 17, 2012

(54) OPERATING METHOD FOR AN ATOMISER AND A CORRESPONDING COATING APPARATUS

(75) Inventors: Benjamin Wöhr, Eibenbach (DE); Hans-Jürgen Nolte, Besigheim (DE); Andreas Fischer, Ludwigsburg (DE); Peter Marquardt, Steinheim (DE); Frank Herre, Flein (DE); Marcus Frey, Weil der Stadt (DE)

(73) Assignee: Durr Systems Inc., Plymouth, MI (US)

( * ) Notice: Subject to any disclaimer, the term of this patent is extended or adjusted under 35 U.S.C. 154(b) by 65 days.

(21) Appl. No.: 12/162,457

(22) PCT Filed: Sep. 19, 2007

(86) PCT No.: PCT/EP2007/008165

§ 371 (c)(1), (2), (4) Date: Jul. 28, 2008

(87) PCT Pub. No.: WO2008/061584

PCT Pub. Date: May 29, 2008

(65) Prior Publication Data

US 2009/0220703 A1 Sep. 3, 2009

(30) Foreign Application Priority Data

Nov. 21, 2006 (DE) ..... 10 2006 054 786

(51) Int. Cl.
*B05D 1/06* (2006.01)
*B05B 5/057* (2006.01)

(52) U.S. Cl. ..... 427/8; 427/475; 427/477; 427/479; 118/679; 118/629

(58) Field of Classification Search ..... 427/8, 475, 427/477, 479; 118/679, 624, 636, 627, 629
See application file for complete search history.

(56) References Cited

U.S. PATENT DOCUMENTS 5,324,547 A 6/1994 Ohhashi et al.

(Continued)

FOREIGN PATENT DOCUMENTS

DE 42 09 279 A1 9/1993

(Continued)

OTHER PUBLICATIONS

PCT/EP International Search Report for PCT/EP2007/008165, 4 pages.

(Continued)

*Primary Examiner* — Frederick Parker
(74) *Attorney, Agent, or Firm* — Rader Fishman & Grauer

(57) ABSTRACT

The invention relates to an operating method for an atomiser (1) for the coating of structural components, particularly of vehicle body parts, with the following steps: Application of a spray jet of a coating agent through the atomiser (1); discharge of a first guide air flow (11) for the formation of a spray jet; determination of at least one application parameter (η, γ, T, BC/CC, Qvarnish, n, U,) which reproduces a property (η, γ, T, BC/CC) of the applied coating agent or an operating variable (Qvarnish, n, U) of the atomiser (1) as well as influencing of the first guide air flow (11) as a factor of the application parameter (η, γ, T, BC/CC, Qvarnish, n, U,). Within the framework of the invention, there is the alternative option that fluctuations of the application parameters and, based thereon, variations of the spray jet width are taken into account by means of an adaptation of the path spacing (d) between the adjacent coating agent paths for the purpose of keeping the path overlapping constant. Furthermore, the invention comprises a corresponding coating apparatus.

27 Claims, 6 Drawing Sheets

U.S. PATENT DOCUMENTS

| | | | | |
|---|---|---|---|---|
| 5,689,415 | A | 11/1997 | Calotychos et al. | |
| 5,814,375 | A | 9/1998 | Hissen | |
| 5,980,994 | A * | 11/1999 | Honma et al. | 427/475 |
| 6,051,280 | A * | 4/2000 | Seitz et al. | 427/475 |
| 6,177,139 | B1 | 1/2001 | Rouvelin | |
| 6,534,127 | B2 | 3/2003 | Ohmoto et al. | |
| 2002/0122892 | A1 | 9/2002 | Dattilo | |
| 2004/0144860 | A1 * | 7/2004 | Nolte et al. | 239/290 |
| 2005/0229845 | A1 | 10/2005 | Mather et al. | |

FOREIGN PATENT DOCUMENTS

| | | | |
|---|---|---|---|
| DE | 196 37 730 | C1 | 1/1998 |
| DE | 199 38 093 | A1 | 2/2001 |
| EP | 0695582 | | 2/1996 |
| EP | 0 829 788 | | 3/1998 |
| EP | 1 331 037 | A2 | 7/2003 |
| GB | 2 118 740 | A | 11/1983 |
| RU | 1297925 | | 3/1987 |
| RU | 1794494 | | 2/1993 |

OTHER PUBLICATIONS

English Language Abstract of DE 199 38 093.
English Language Abstract of EP 1 331 037 A2.
English Language Abstract of DE 42 09 279 A1.
English Language Abstract of EP 0 829 788 A2.

* cited by examiner

OPERATING METHOD FOR AN ATOMISER AND A CORRESPONDING COATING APPARATUS

This application is a National Phase application claiming the benefit of International Application No. PCT/EP 2007/008165, filed Sep. 19, 2007, which claims priority to German Patent Application No. 10 2006 054 786.1, filed Nov. 21, 2006, the complete disclosures of which are hereby incorporated in by reference in their entireties.

FIELD

The invention relates to an operating method for an atomiser for the coating of components, in particular vehicle body parts. Furthermore, the invention relates to a corresponding coating apparatus.

BACKGROUND

From EP 1 331 037 A2 a rotation atomiser is known which discharges a spray jet of a coating agent by means of a rotating bell. For the purpose of shaping the spray jet discharged from the bell, this rotation atomiser has a plurality of guide air nozzles which are arranged in two concentric rings around the bell and which discharge a guide air stream (shaping air) from the rear in an essentially axial direction onto the spray jet, through which the spray jet width can be adjusted.

For an internal painting, a small spray jet width is adjusted due to the restricted space conditions where, by way of the guide air nozzles, a large guide air flow is discharged which presses the spray jet together from the outside.

For an external painting, however, a wide spray jet is preferably adjusted in order to enable the painting of large component surfaces in a quick and efficient manner. For this purpose, a small guide air flow is discharged at the very most, so that the spray jet is pressed together to a small extent only.

Therefore, with the known rotation atomiser various values are adjusted for the guide air flow in order to optionally obtain a narrow spray jet or a wide spray jet.

The disadvantage with the method for adjusting the guide air flow as described above is the fact that the correlation between a certain guide air flow and the resulting spray jet width in the operation of the rotation atomiser is subject to variations and this makes an exact adjustment of the spray jet width difficult.

From U.S. Pat. No. 6,534,127 B2 a guide air control is known where the temperature and the humidity of the discharged guide air are controlled. In this case, however, the spray jet width is also dependent on the current operating conditions of the rotation atomiser because the correlation between the guide air volume flow and the resulting spray jet width fluctuates depending on the current operating conditions.

From US 2002/0122892 A1 a guide air control is known where the speed of the guide air flow is influenced in order to keep a so-called control relationship constant, wherein the matter involved is the relationship between the product of rotational speed and guide air volume on the one hand and the coating agent volume flow on the other. In this case, therefore, the control pursues a different control objective and does not prevent a variation of the spray jet width depending on the current operating conditions.

Finally, DE 199 38 093 A1 discloses a control system which controls the guide air volume flow as a control variable to a pre-specified set value, wherein the set value can be varied according to the desired spray jet width. In this case, however, the problem occurs in that the correlation between the guide air volume flow and the resulting spray jet width fluctuates depending on the current operating conditions of the rotation atomiser.

Therefore, the object underlying the invention is to improve the known rotation atomiser as described above and the operating method related to it.

This object is achieved by the exemplary operating methods and coating apparatuses, respectively, disclosed herein.

BRIEF DESCRIPTION OF THE FIGURES

Various advantageous further developments of the invention are identified in the dependent claims or are described as follows in greater detail together with the description of the preferred embodiment examples of the invention on the basis of the Figures. These Figures show the following:

DETAILED DESCRIPTION

Figure 1:
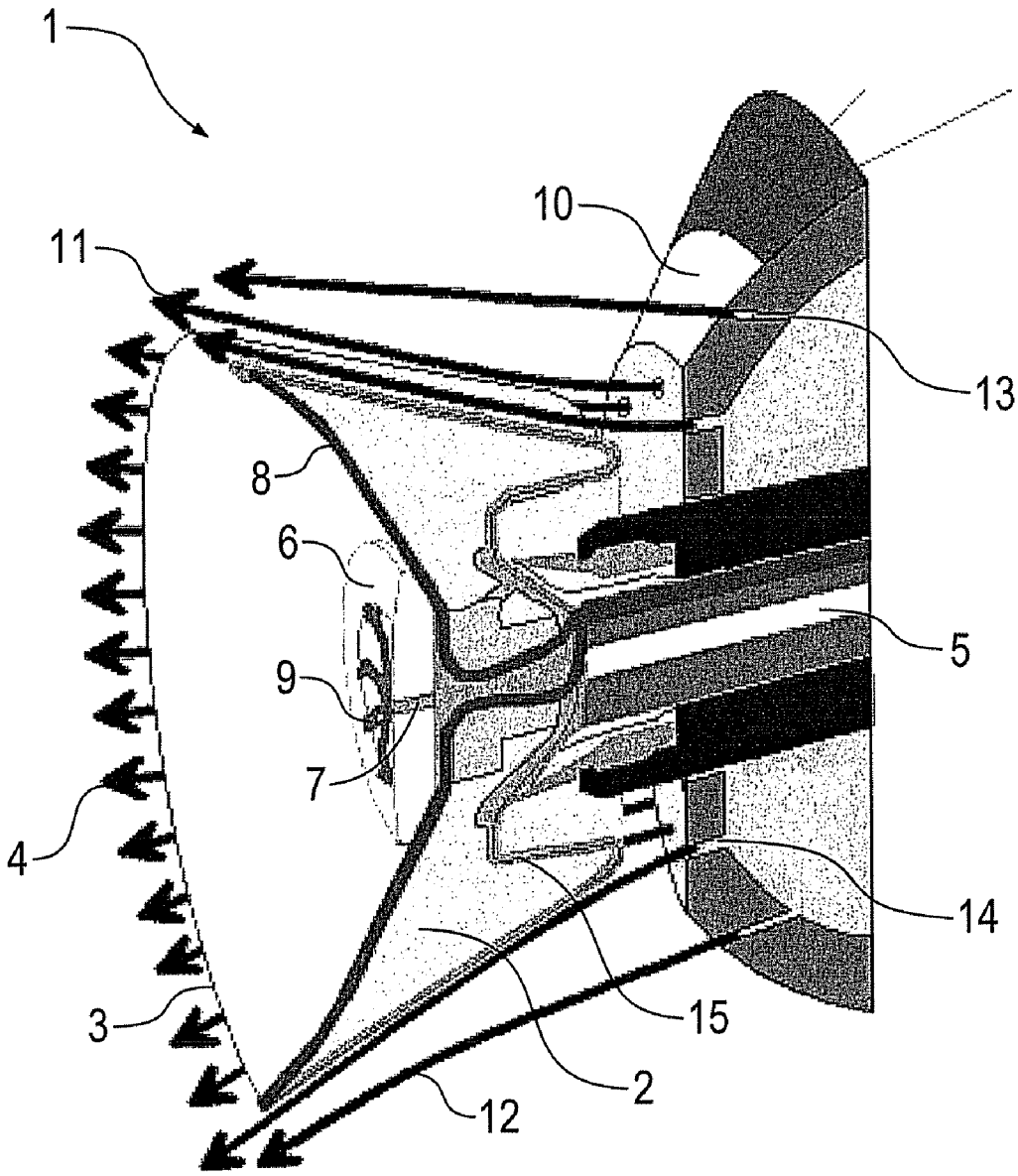
FIG. 1 a sectioned perspective view of a rotation atomiser with two guide airs, FIG. 2 a further embodiment example of a rotation atomiser with two guide airs, FIG. 3A a front view of a guide air ring with two guide air nozzle anuluses, FIG. 3B a cross-sectional view of the guide air ring from FIG. 3A, FIG. 4 a front view of an alternative embodiment example of a guide air ring for i. usage within the framework of the invention, FIG. 5 a schematic side view of a rotation atomiser with two guide airs, FIG. 6 a simplified picture of a coating apparatus according to the invention, and FIGS. 7A, 7B a simplified illustration of varnishing paths on the components.

The invention is based on the technical knowledge that the spray jet width not only depends on the guide air flow but also on the kinetic energy of the individual paint droplets in the applied spray jet. For instance, individual coating agent parameters (e.g. paint viscosity, paint surface tension) require individually adapted atomiser parameters (e.g. rotational speed of the bell) in order to obtain the individually required drop spectra for an optimal paint application. This adaptation of the atomiser parameters (e.g. rotational speed of the bell) to the current coating agent parameters (e.g. paint viscosity), however, leads to correspondingly and individually different kinetic energies of the coating agent droplets which, in the result, requires a corresponding adaptation of the guide air flow for the purpose of obtaining the desired spray jet width.

The invention therefore envisages that, in the operation of the atomiser, an application parameter is determined which reproduces a characteristic (e.g. viscosity, surface tension) of the applied coating agent or an operating variable (e.g. rotational speed) of the atomiser and which has a effect on the applied spray jet, particularly on the kinetic energy of the sprayed-off coating agent droplets.

In a first variant of the invention, the guide air flow is influenced in dependence of this application parameter in order to adjust the desired shape and/or width of the applied spray jet. Giving consideration to the application parameter with the influencing of the guide air flow has the advantage that the different kinetic energies of the applied paint droplets can be taken into account, through which the desired spray jet width can be adjusted more precisely than in the case of the conventional rotation atomiser described above.

The invention therefore envisages preferably an open-loop control of the spray jet width, meaning, without a measurement and feedback of the spray jet width as the variable to be controlled. In this case, the spray jet width is the variable to be controlled (control variable) which is controlled depending on the variable application parameter (e.g. paint viscosity, paint temperature, atomiser rotational speed, etc.) as a disturbance variable. For controlling the spray jet width to the pre-specified set value, the guide air flow is adjusted as a set variable in dependence of the variable application parameter. The objective of the control in this case is to adjust the spray jet width independently of variations of the application parameter to a pre-specified set value.

In another variant of the invention, in contrast, the spray jet width is not open-loop controlled. Instead, variations of the spray jet width are compensated wherein the path spacing and/or the painting speed (drawing speed) between the adjacent coating agent paths is adapted accordingly. The term of the painting speed adopted within the framework of the invention refers preferably to the forward feed velocity of the application device during the painting process.

If, for example, the spray jet width decreases as a result of fluctuations of the application parameters (e.g. paint viscosity, paint temperature, atomiser rotational speed, etc.), the path spacing is therefore reduced accordingly so that the desired path overlapping is maintained.

If, by contrast, the spray jet width increases as a result of fluctuations of the application parameters (e.g. paint viscosity, paint temperature, atomiser rotational speed, etc.), the path spacing is therefore enlarged accordingly in order to maintain the desired path overlapping.

In this variant of the invention, the invention therefore envisages that the path overlapping between the adjacent coating agent paths is controlled to a pre-specified and desired path overlapping, wherein the path spacing is correspondingly adjusted in dependence of the variable application parameter (e.g. paint viscosity, paint temperature, atomiser rotational speed, etc.).

The two variants of the invention as described above (control of the spray jet width and the control of the path overlapping, respectively) can also be combined with one another within the framework of the invention.

Both variants of the invention have in common the technical directive that the fluctuations of the application parameters are compensated by an adaptation of the spray jet width or by an adaptation of the path spacing.

Moreover, in the control of the path overlapping, the layer thickness can be controlled by adjusting the painting speed (meaning, the forward feed velocity of the atomiser in the direction of the path). The control of the layer thickness can also be effected, within the framework of the invention, in dependence of the variable application parameter.

The term of an application parameter within the framework of the invention therefore comprises all variables which have an effect on the spray jet during the coating operation, particularly on the kinetic energy of the sprayed-off coating agent droplets or the spray jet shape. In addition, this term is not restricted to individual variables but also comprises several different variables. In this way, the control of the spray jet width and/or the path overlapping can also take place in dependence of several variable application parameters.

In addition, a guide air flow within the framework of the invention is understood to mean the volume of the discharged guide air per time unit, therefore in the physical sense the volume flow or the mass flow of the discharged guide air.

The invention preferably envisages that not only one single guide air flow is discharged but—as in the above-mentioned patent application EP 1 331 037 A2—at least one additional guide air flow. The application parameter (e.g. paint viscosity, bell rotational speed) is adopted preferably for the influencing of all guide air flows.

In this case the individual guide air flows are discharged in various directions, a fact that is known from the patent application EP 1 331 037 A2 as already mentioned above. Here, the individual guide air flows are preferably superimposed to a resulting guide air flow whose direction depends on the individual guide air flows. With an individual adjustment of the individually superimposed guide air flows, the direction of the resulting guide air flow can therefore be influenced within the framework of the invention. Preferably, the influencing of the direction of the resulting guide air flow takes place here in dependence of the above-mentioned application parameter (e.g. viscosity of the coating agent, rotational speed of the atomiser). Therefore, the invention enables a variable direction orientation of the resulting guide air flow for the extended and flexible parametering of the atomiser for the purpose of obtaining an economical paint application for various requirements with optimal layer thickness (application efficiency), layer distribution and quality.

It was already mentioned above that the application parameter adopted for the influencing of the guide air flow can be the viscosity of the applied coating agent or the rotational speed of the atomiser. However the invention, with reference to the application parameter of interest, is not restricted to these two parameters but is also realisable with other parameters. The application parameter can be, for example, the surface tension of the applied coating agent, the electric voltage of an electrostatic charging of a coating agent, the temperature of the applied coating agent, the ambient temperature, the coating agent flow and/or the type of the applied coating agent. Beyond this, and within the framework of the invention, there is the possibility that several of the above-mentioned application parameters are evaluated in common and influence in common the guide air flow.

The individual guide air flows, within the framework of the invention, can be selectively supplied with guide air from a common air supply or from own air supplies in each individual case. The advantage of a supply of the single guide air flows by own air supplies in each case is, however, the fact that the single guide air flows can be adjusted flexibly and independently of one another.

It is to be mentioned further that the guide air flow influencing, within the framework of the invention, takes place automatically so that no user intervention is necessary in order to compensate the influence of the varying application parameter during the adjustment of the spray jet width.

Furthermore, it is to be mentioned that the coating agent, within the framework of the invention, can be alternatively powder paint or wet paint (solvent paint or water paint). Therefore the invention, with reference to the coating agent to be applied, is not restricted to certain coating agent types.

Furthermore, it is to be mentioned that the invention is not restricted to the operating method as described above, but also comprises a corresponding coating apparatus as already apparent from the above-mentioned description. The influencing of the guide air flow takes place here by means of a control apparatus which, for example, activates a guide air valve in order to take into consideration the application parameter (e.g. paint viscosity, bell rotational speed) during the influencing of the guide air flow.

With two separate guide air flows, the control apparatus preferably influences both guide air flows wherein the influencing of the individual guide air flows can take place independently of one another.

In one embodiment of the invention, a guide air flow arrangement is envisaged which has several concentrically arranged nozzle openings in each case, a configuration that is known from the state of the art. The individual guide air flows here can be discharged through an own annulus of guide air nozzles, wherein the individual guide air nozzle anuluses are preferably arranged concentrically to one another.

There is the possibility in this case that the individual guide air nozzle anuluses have a different diameter. A guide air flow can then be discharged from externally located guide air nozzles while another guide air flow is discharged from the internally located guide air nozzles.

However, there is also the alternative option that the individual guide air nozzle anuluses essentially have the same diameter so that, distributed over the periphery in an alternating manner, nozzle openings of the first guide air nozzle arrangement and the second guide air nozzle arrangement are located. The nozzle openings of both guide air nozzle arrangements can be united here in couples in each case, so that numerous couples of guide air nozzles are arranged over the periphery, wherein each of these couples each have a guide air nozzle for each guide air flow.

Moreover, there is also the possibility that the individual nozzle openings have a twist in the peripheral direction, selectively in the direction of rotation or opposite the direction of rotation of the bell. For example, the nozzle openings of the one guide air nozzle arrangement can also have a twist in the peripheral direction while the nozzle openings of the other guide air nozzle arrangement do not have a twist in the peripheral direction. In this case, the nozzle openings provided with a twist in the peripheral direction can have a twist angle of between 30° and 75°, wherein a twist angle of 45° has proven to be advantageous.

It is to be finally mentioned that, within the framework of the invention, three or more guide air flows can also be discharged in order to shape the spray jet. In this case, the additional third guide air flow can be influenced in the same way as the two guide air flows already described. In addition to this, the individual guide air flows can also be applied as clearing air in order to keep the bell free of fouling matter. Furthermore, there is also the possibility that the individual guide air flows can be heated or air-conditioned in any other way, a mode that is known as such from the state of the art.

The cross-sectional view in FIG. 1 shows a rotation atomiser 1 for the application of wet paint, for example solvent paint or water paint.

As an application element, the rotation atomiser 1 has a bell 2 which rotates at high speed during operation and which discharges a spray jet 4 at a ring-shaped peripheral spraying edge 3.

In this case the wet paint to be applied is supplied through a colour tube 5 and then makes contact, at first, in the bell 2 with a deflection disk 6 with a passage bore 7 rotating with the bell 2, wherein the deflection disk 6 splits up the axially impacting paint flow in two partial flows 8, 9. The partial flow 8 is laterally diverted by the deflection disk 6 in the radial direction and flows along an internally located overflow surface to the outside to the spraying edge 3 as a result of the centrifugal force occurring during operation, where the paint is then discharged in the form of a spray jet 4.

The partial flow 9, however, passes axially all the way through the passage bore 7 in the deflection disk 6 and then flows on the face side of the deflection disk 6 as a result of the centrifugal force in the radial direction to the outside so that there is a permanent flow also over the face surface of the deflection disk 6 during operation.

Furthermore, the rotation atomiser 1 has a guide air ring 10, over which two guide air flows 11, 12 are discharged to the front in order to shape the spray jet 4.

For the discharge of the outer guide air flow 12, the guide air ring 10 has an annulus of guide air nozzles 13 which are in a distributed arrangement over the periphery of the guide air ring 10 in a pre-specified radius to the rotary axis of the bell 2.

The discharge of the inner guide air flow 11 is also effected by way of an annulus of guide air nozzles 14 which are arranged in the guide air ring 11 in a pre-specified radius with reference to the rotary axis of the bell 2.

The guide air nozzles 13 discharge the guide air flow 12 slightly slanted forward to the outside, wherein the guide air flow 12 includes an angle of approx. 15° with the rotary axis of the bell 2.

The guide air flow 11, however, is discharged from the guide air nozzles 14 almost coaxially to the rotary axis of the bell 2.

Both guide air flows 11, 12 are then superimposed in the operation of the rotation atomiser 1 to a resulting guide air stream with a certain flow velocity and a certain flow direction. In the operation of the rotation atomiser 1, the flow direction and the flow velocity of the resulting guide air stream can be varied wherein the guide air flow is adjusted by the guide air nozzles 13, 14 independently of one another. The two guide air flows 11, 12 are then adjusted in such a way that, independently of the applied paint and independently of the operating parameters (e.g. bell rotational speed) of the rotation atomiser 1, the desired shape and width of the spray jet 4 is adjusted at all times. This adjustment takes into account that individual paint parameters such as, for example, paint viscosity and paint surface tension require correspondingly adapted operating parameters (e.g. speed) of the rotation atomiser 1 in order to obtain the individually required drop spectra for an optimal paint application, so that the drop spectra have correspondingly different kinetic energies.

In addition, the rotation atomiser 1 enables yet another external purging by means of a purging agent flow 15 which is guided over the outer surface of the bell 2 and, in this way, clears this from any possibly adhesive paint residuals. Such an external purging is, however, known as such from the state of the art and therefore does not require a more detailed description.

Figure 2:
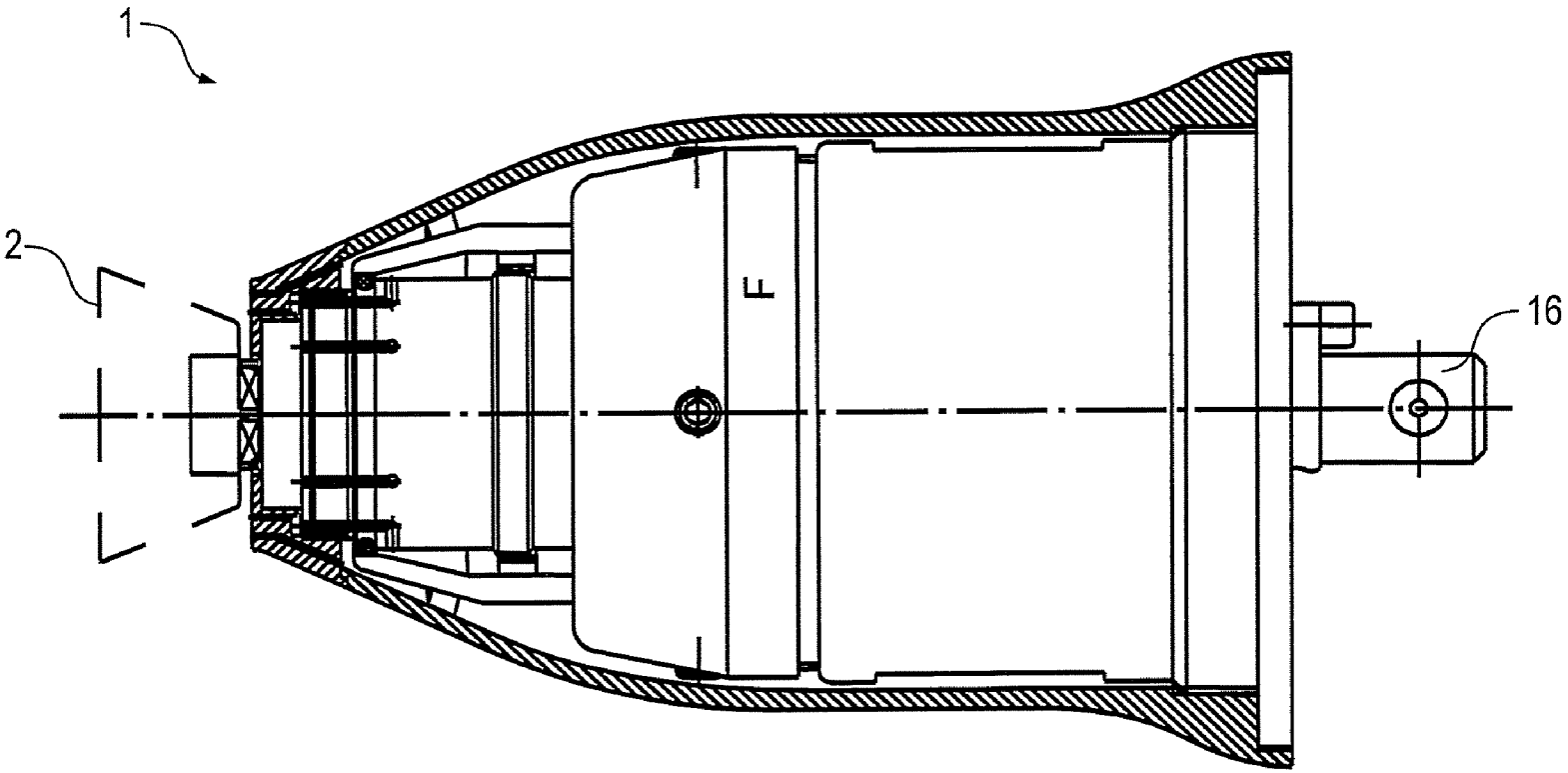

FIG. 2 shows a cross-sectional view of the complete rotation atomiser 1 with the bell 2 and a securing pin 16 for fastening the rotation atomiser 1 to a robot hand axis of the painting robot which is also known as such from the state of the art and therefore does not have to be described in greater detail. For this reason and in order to avoid repetitions with regard to the description of the rotation atomiser 1, reference is made to the patent application EP 1 331 037 A2 whose contents are to be allocated in the full scope to the description as presented here.

Figure 3A:
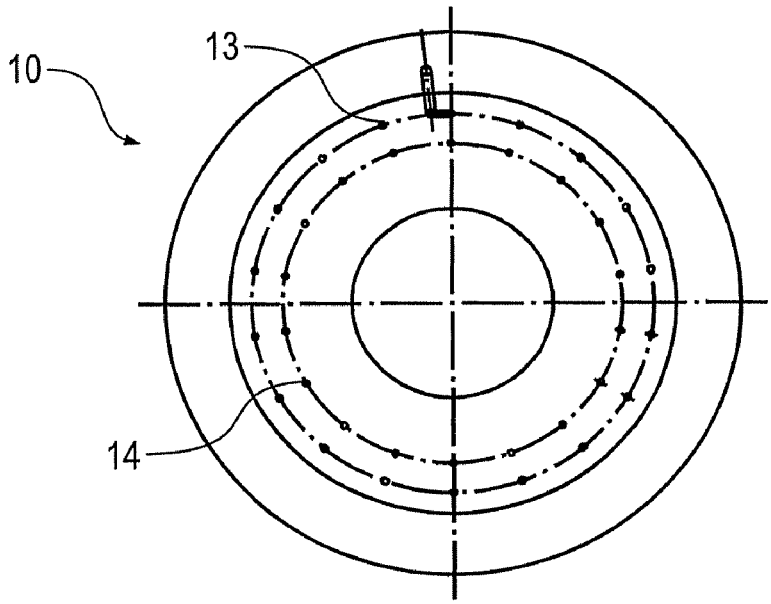
Figure 3B:
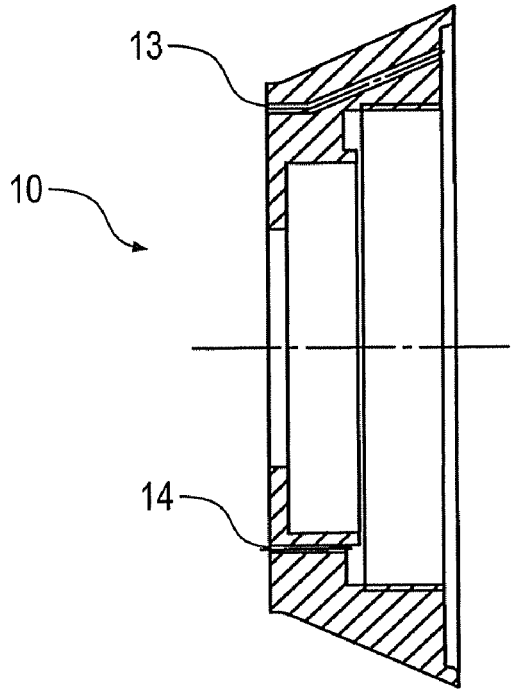

The FIGS. 3A and 3B show a front view and a cross-sectional view, respectively, of the guide air ring 10 in a possible alternative embodiment. For this reason and in order to avoid repetitions, reference is made here essentially to the description as given here, wherein the same reference numbers are adopted as follows for corresponding details.

A particular feature of the guide air ring 10 in this embodiment example is that the inner guide air nozzles 14 and the outer guide air nozzles 13 each discharge the respective guide air flow axis-parallel to the rotary axis of the bell 2.

Figure 4:
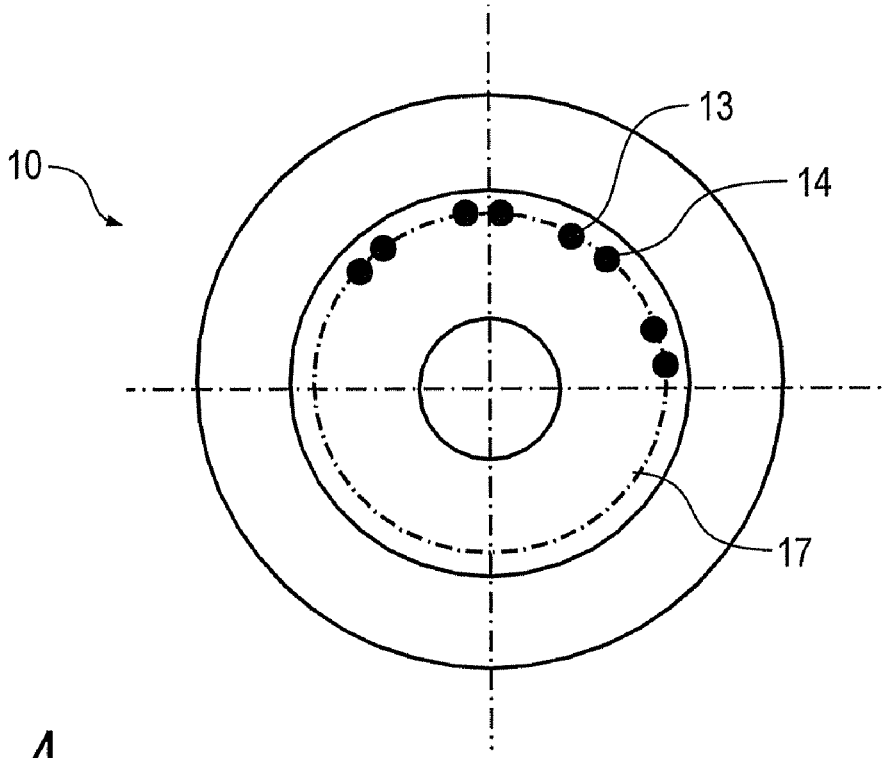

FIG. 4 shows a further embodiment example of a guide air ring 10 which also conforms extensively with the embodiment examples as described above, so that in order to avoid repetitions, reference is made again to the description as given above, wherein the same reference numbers are adopted as beforehand for corresponding details.

A particular feature of this embodiment is that, in the guide air ring 10 on a pre-specified diameter 17, the guide air nozzles 13 for the one guide air flow and the guide air nozzles 14 for the other guide air flow are each arranged in couples. In this case, numerous such couples of the guide air nozzles 13, 14 are arranged in distribution over the periphery. The two guide air flows emerging from the guide air nozzles 13, 14 can be controlled here independently of one another and superimpose to a resulting guide air stream with a certain flow direction and a certain flow velocity.

Figure 5:
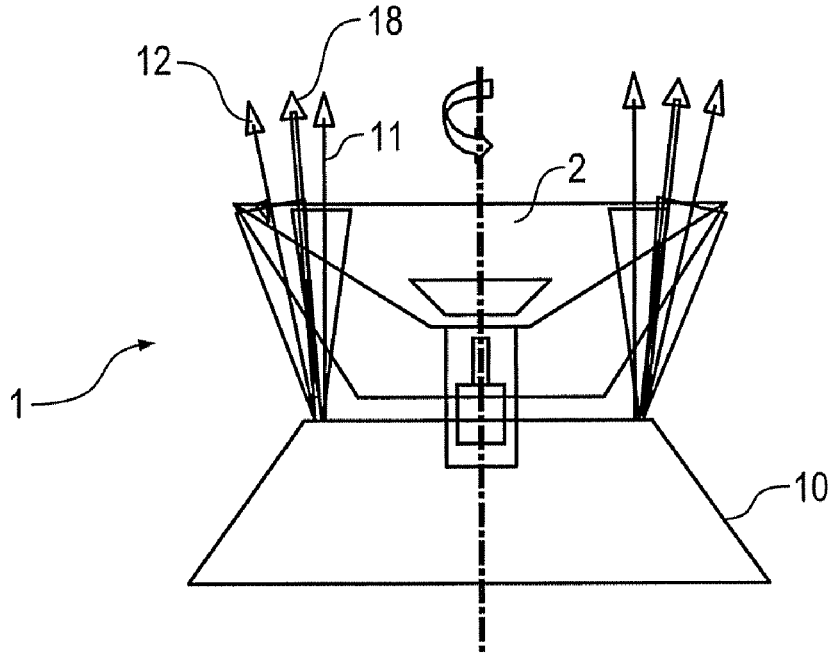

FIG. 5 shows a further and highly simplified embodiment example of the rotation atomiser 1 according to the invention which conforms extensively with the embodiment examples as described above, so that in order to avoid repetitions, reference is made to the description as given above, wherein the same reference numbers are adopted as follows for corresponding details.

With this embodiment example the inner guide air flow 11 is discharged axis-parallel to the rotation axis of the bell 2 wherein, by contrast, the guide air flow 12 is discharged at an acute angle and slanted to the outside. The two guide air flows 11, 12 therefore superimpose to a resulting guide air stream 18 with a certain resulting flow direction and a corresponding flow velocity. The two guide air flows 11, 12 can be adjusted in this case independently of one another in order to adjust the flow direction and the flow velocity of the resulting guide air stream 18 correspondingly to the current requirements.

Figure 6:
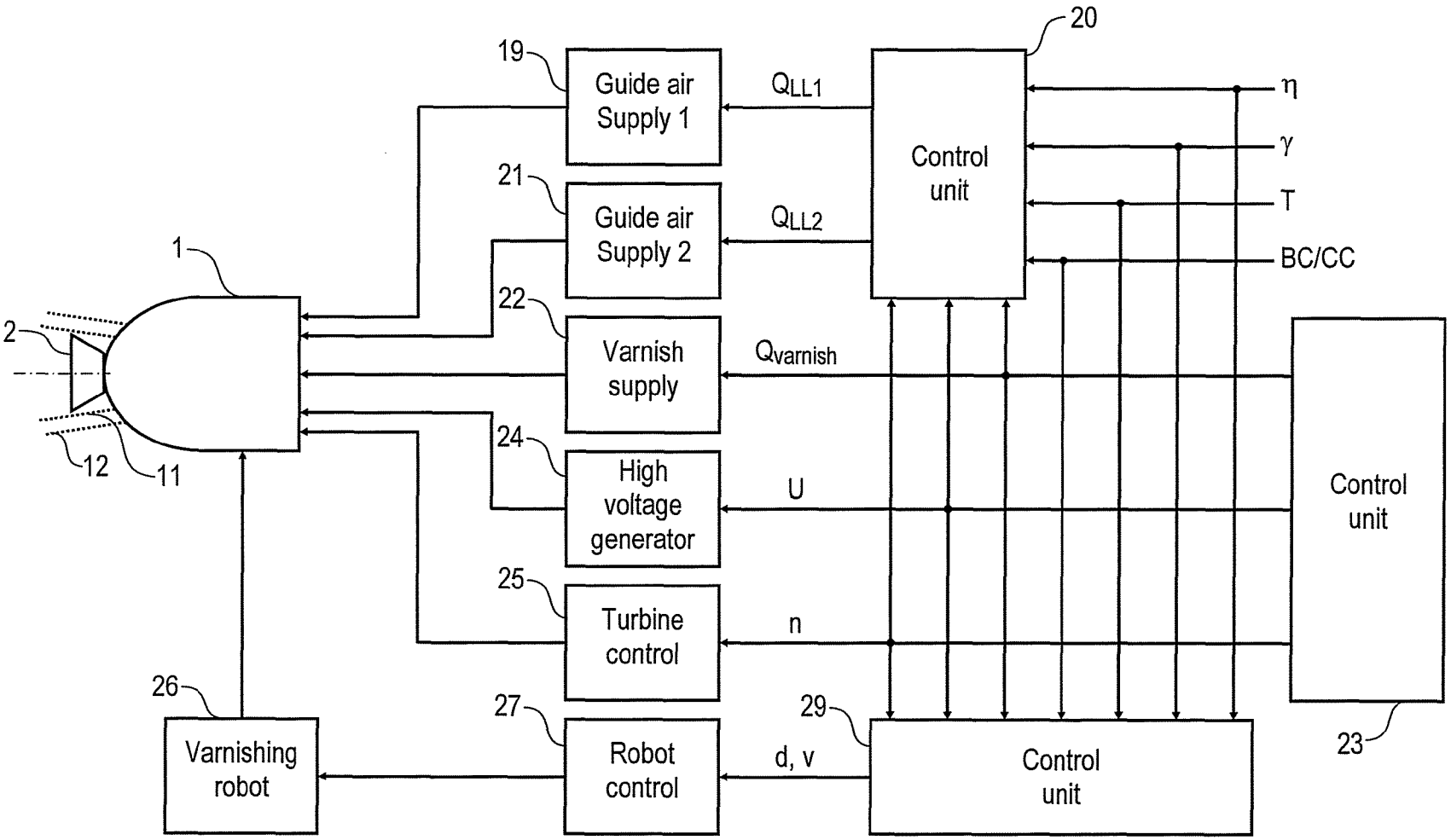

FIG. 6 shows in a highly simplified and schematised form an embodiment example of a coating apparatus which, according to the invention, enables the adjustment of the guide air flows 11, 12.

At first, the coating apparatus has a guide air supply 19 which supplies the rotation atomiser 1 with the guide air flow 11, wherein the guide air supply 19 is controlled by a control unit 20 in such a way that the guide air supply 19 discharges a pre-specified guide air flow $Q_{LL1}$.

Furthermore, the coating apparatus has a second air guide supply 21 which supplies the second guide air flow 12 to the rotation atomiser 1, wherein also the guide air supply 21 is activated by a control unit 20, so that the rotation atomiser 1 discharges a pre-specified guide air flow $Q_{LL2}$.

Furthermore, the coating apparatus has in a conventional way a paint supply 22 which supplies the rotation atomiser 1 with a pre-specified paint flow $Q_{paint}$ wherein the desired paint flow $Q_{paint}$ is pre-specified by a control unit 23.

In addition, the coating apparatus has a high voltage generator 24 which supplies the rotation atomiser 1 with an electrostatic charging voltage U with which the spray jet 4 discharged from the bell 2 is electrostatically charged. The electrostatic charging of the spray jet 4 is known from the state of the art and, therefore, requires no further description.

Furthermore, the control unit 23 transmits a rotational speed value n to a turbine control 25, wherein the turbine control 25 discharges a corresponding turbine air flow to the rotation atomiser 1 so that the bell 2 turns with the desired rotational speed n. The turbine control 25 contains here a control with a feedback as the actual rotational speed is determined and is used for the control and, as required, for the adaptation of the rotational speed.

The control unit 20 calculates both guide air flows $Q_{LL1}$, $Q_{LL2}$ depending on several application parameters which are partially operating variables of the rotation atomiser 1 and which partially reproduce properties of the applied paint. In this way, the control unit takes into account the applied paint flow $Q_{paint}$, the electrostatic charging voltage U and the rotational speed n of the bell 2 as operating variables of the rotation atomiser 1.

Furthermore, the control unit 20 also takes into account the viscosity η, the surface tension γ and the temperature T of the applied paint for the calculation of the guide air flows $Q_{LL1}$, $Q_{LL2}$. Finally, the control unit 20 also takes into account the type of paint applied (BC: Base Coat or CC: Clear Coat).

For the calculation of the two guide air flows $Q_{LL1}$, $Q_{LL2}$, the control unit takes into account that, depending on the individual application parameters, different drop spectra are formed in the applied spray jet 4 which have correspondingly different kinetic energies, so that the two guide air flows 11, 12 must be adapted and aligned accordingly and/or measured, respectively.

Figure 7A:
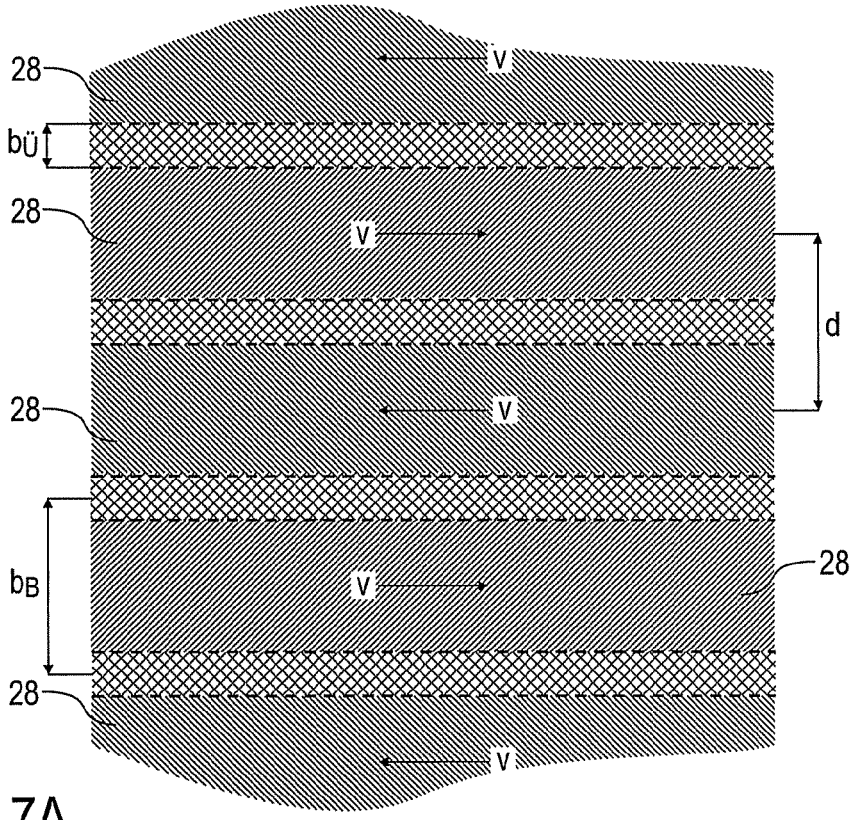
Figure 7B:
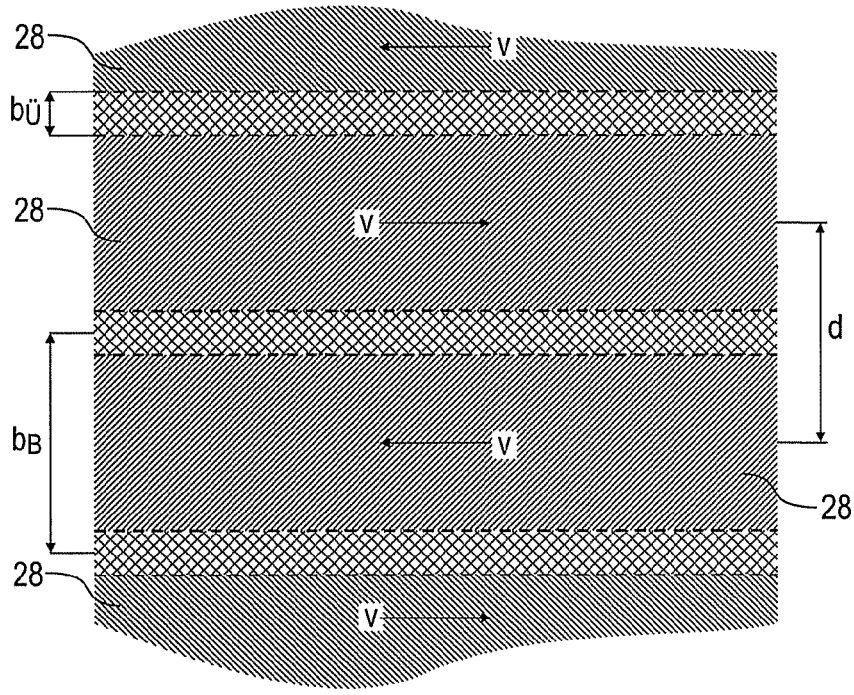

Moreover, the coating apparatus has a multiple-axis painting robot 26 which is driven by a robot control 27 and guides the rotation atomiser 1 so that the rotation atomiser 1 deposits coating agent paths 28 onto the components to be coated wherein said paths lie parallel next to each other, as shown in FIGS. 7A and 7B.

The adjacent coating agent paths 28 have between their central axes, in each case, a certain path spacing d and a certain path width $b_B$, from which a certain path overlapping $b_O$ results.

From a comparison of the FIGS. 7A and 7B it is evident that the path width $b_B$ can fluctuate, and this is attributable to variations of the spray jet width where in turn the variations of the spray jet width are caused by changes of the application parameters.

With a constant path spacing d, however, the variations of the path width $b_B$ lead to undesirable variations of the path overlapping $b_O$. In the extreme case, a reduction of the path width $b_B$ can even lead to a situation where the path overlapping $b_O$ becomes negative so that the adjacent coating agent paths 28 no longer have an unbroken adjoining to one another.

Therefore, the coating apparatus also enables another variant for the consideration of fluctuations of the application parameters. In this variant of the invention the spray jet width is not controlled to a constant pre-specified value wherein the control gives consideration to fluctuations of the application parameters. Instead, this variant envisages that the variations of the spray jet width are allowed and compensated where the path spacing d is adapted accordingly.

For this reason, the coating apparatus has a control unit 29 which, on the inlet side, takes up the application parameters η, γ, T, BC/CC, $Q_{paint}$, n, U where the application parameters η, γ, T, BC/CC, $Q_{paint}$, n, U are disturbance variables in the control-technical sense because fluctuations of the application parameters η, γ, T, BC/CC, $Q_{paint}$, n, U influence the path overlapping $b_O$ when the path spacing d is kept constant.

For this reason, the control unit 29 controls the path overlapping $b_o$ to a certain pre-specified constant value wherein the control unit 29 adjusts the path spacing d accordingly and, with this, activates the robot control 27 accordingly.

If, for example, the spray jet width reduces because of fluctuations of the application parameters (e.g. paint viscosity, paint temperature, atomiser rotational speed, etc.), the path spacing d is reduced accordingly so that the desired path overlapping $b_O$ remains upheld.

If, however, the spray jet width increases because of fluctuations of the application parameters (e.g. paint viscosity, paint temperature, atomiser rotational speed, etc.), the path spacing d is enlarged accordingly in order to maintain the desired path overlapping $b_O$ remains upheld.

In addition to this, the control unit 29 controls the layer thickness to a pre-specified value wherein the painting velocity v is adjusted depending on the application parameters η, γ, T, BC/CC, $Q_{paint}$, n, U. The painting velocity v in this case is the forward feed velocity of the rotation atomiser 1 along the coating agent paths 28. In this way, the layer thickness is maintained at a constant value independent of fluctuations of the application parameters η, γ, T, BC/CC, $Q_{paint}$, U, and this contributes to a good coating quality.

In this case, the desired set value for the spray jet width depends on the type of painting. When painting external surfaces a large spray jet width is normally purposeful so that painting is performed with a wide-surface mode. For internal painting as well as for the painting of small details, on the other hand, a small spray jet width is purposeful.

The invention is not restricted to the preferred embodiment examples described above. Moreover, a multiplicity of variants and variations are possible which make use of the invention concept and spirit and are therefore covered by the scope and extent of protection.

The invention claimed is:

1. An operating method for an atomiser for the coating of components comprising:

a) Presetting a desired spray jet width for the atomiser;

b) Application of a spray jet of a coating agent through the atomiser, wherein the spray jet comprises an actual spray jet width;

c) Determination of at least one application parameter which reproduces a characteristic of the applied coating agent or an operating variable of the atomiser;

d) Discharge of a first guide air flow onto the spray jet for shaping the spray jet;

e) Controlling the actual spray jet width to the preset and desired spray jet width by adjusting the first guide air flow depending on the determined application parameter, including modifying the actual spray jet width to a modified spray jet width in response to a change in the at least one application parameter during the application of the spray jet.

2. The method according to claim 1, further comprising the following steps:

a) Discharge of an additional second guide air flow onto the spray jet for shaping the spray jet, and b) Influencing also of the second guide air flow depending on the application parameter which has been determined for the control of the spray jet width.

3. The method according to claim 2, wherein the first guide air flow is discharged into another direction than the second guide air flow.

4. The method according to claim 3, wherein a) the first guide air flow superimposes with the second guide air flow to a resulting guide air stream, b) the first guide air flow and the second guide air flow are influenced depending on the application parameter which has been determined in such a way that the direction of the resulting guide air stream changes.

5. The method according to claim 2, wherein the first guide air flow and the second guide air flow are supplied with guide air from a common air supply.

6. The method according to claim 2, wherein the first guide air flow and the second guide air flow are each supplied from an own air supply in each case.

7. The method according to claim 1, wherein the application parameter includes at least one of:

a viscosity of the applied coating agent, a surface tension of the applied coating agent, an electric voltage of an electrostatic charging of the coating agent, a temperature of the applied coating agent, an ambient temperature, an air humidity, and a type of the applied coating agent, the type including one of a base coating agent and a clear coating agent.

8. The method according to claim 1, wherein the influencing of the first guide air flow automatically takes place depending on the application parameter, which has been determined.

9. An operating method for an atomiser for the coating of components comprising the following steps:

a) Presetting of a desired path overlapping between adjacent coating agent paths on the components;

b) Application of a spray jet of a coating agent through the atomiser;

c) Determination of at least one application parameter which reproduces a characteristic of the applied coating agent or an operating variable of the atomiser;

d) Depositing of parallel coating agent paths onto the components, wherein the adjacent coating agent paths have an actual path spacing between their central axes and an actual path overlapping;

e) Controlling the actual path overlapping of the adjacent coating agent paths to the preset and desired path overlapping according to at least the at least one application parameter, including modifying the actual path spacing to a modified path spacing in response to a change in the at least on application parameter during the application of the spray jet, the actual path overlapping of the adjacent coating agent paths remaining substantially constant.

10. The method according to claim 9, wherein the actual path overlapping is controlled by adjusting the path spacing.

11. The method according to claim 9, wherein the actual path overlapping is controlled by adjusting a velocity of the coating agent.

12. The method according to claim 11, further comprising the following steps:

a) Depositing of the coating agent paths with a certain coating agent velocity, wherein the coating agent velocity is a forward feed velocity of the atomiser in the path direction, and b) Influencing of the coating agent velocity depending on the determined application parameter.

13. The method according to claim 12, further comprising the following steps:

a) Presetting a desired layer thickness for the coating agent paths, and b) Control of the actual layer thickness to the preset and desired layer thickness by adjusting the coating agent velocity depending on the application parameter which has been determined.

14. A coating apparatus for the coating of components with a coating agent, comprising:

a) an atomiser configured to apply a spray jet of the coating agent onto the component to be coated, wherein the spray jet comprises an actual spray jet width;

b) a control apparatus for controlling the atomiser;

c) determination means for determining of at least one application parameter which reproduces a characteristic of the applied coating agent or an operating variable of the atomiser;

d) a first guide air nozzle arrangement for the discharge of a first guide air flow onto the spray jet for shaping the spray jet; wherein e) the control apparatus is configured to control the actual spray jet width to a preset spray jet width by adjusting the first guide air flow depending on the application parameter which has been determined by the determination means, wherein the control apparatus is configured to modify the actual spray jet width to a modified spray jet width in response to a change in the at least one application parameter during the application of the spray jet.

15. The coating apparatus according to claim 14, further comprising a second guide air nozzle arrangement for discharging a second guide air flow for shaping the spray jet, wherein the control apparatus also influences the second guide air flow depending on the application parameter in order to control the spray jet width.

16. The coating apparatus according to claim 15, wherein the first guide air nozzle arrangement, on the one hand, and the second guide air nozzle arrangement, on the other hand, discharge the guide air flows in different directions.

17. The coating apparatus according to claim 16, wherein a) the first guide air flow superimposes with the second guide air flow to a resulting guide air stream, and b) the control apparatus influences the first guide air flow and the second guided air flow depending on the application parameter in such a way that the direction of the resulting guide air stream changes according to the application parameter.

18. The coating apparatus according to claim 15, further comprising a common air supply for the supply of the two guide air flows.

19. The coating apparatus according to claim 15, further comprising in each case, own air supplies for supplying the two guide air flows.

20. The coating apparatus according to claim 15, wherein the first guide air nozzle arrangement and the second guide air nozzle arrangement each have several concentrically arranged nozzle openings.

21. The coating apparatus according to claim 20, wherein the two guide air nozzle arrangements have different diameters.

22. The coating apparatus according to claim 20, wherein the two guide air nozzle arrangements have essentially the same diameter.

23. The coating apparatus according to claim 20, wherein alternating nozzle openings of the first guide air nozzle arrangement and the second guide air nozzle arrangement are in a distributed arrangement over the periphery.

24. The coating apparatus according to claim 20, wherein a) the nozzle openings of the first guide air nozzle arrangement have a twist in the peripheral direction, while b) the nozzle openings of the second guide air nozzle arrangement have no twist in the peripheral direction.

25. The coating apparatus according to claim 24, wherein the nozzle openings with a twist in the peripheral direction have a twist angle of between 30° and 75°.

26. A coating apparatus for the coating of components with a coating agent, comprising:

a) an atomiser for the application of a spray jet of the coating agent onto the component to be coated;

b) a control apparatus for controlling the atomiser, c) determination means for determining of at least one application parameter which reproduces a characteristic of the applied coating agent or an operating variable of the atomiser;

d) a coating robot for a mobile guiding of the atomiser, so that the atomiser deposits parallel coating agent paths onto the components, wherein the adjacent coating agent paths have an actual path spacing and an actual path overlapping; wherein e) the control apparatus controls the actual path overlapping to a preset path overlapping according to the at least one application parameter, wherein the control apparatus is configured to modify the actual path spacing to a modified path spacing in response to a change in the at least one application parameter during the application of the spray jet, the actual path overlapping of the adjacent coating agent paths remaining substantially constant.

27. The coating apparatus according to claim 26, wherein the control apparatus controls the actual path overlapping by adjusting the path spacing depending on the application parameter.

* * * * *

UNITED STATES PATENT AND TRADEMARK OFFICE

CERTIFICATE OF CORRECTION

PATENT NO. : 8,097,293 B2
APPLICATION NO. : 12/162457
DATED : January 17, 2012
INVENTOR(S) : Benjamin Wohr et al.

It is certified that error appears in the above-identified patent and that said Letters Patent is hereby corrected as shown below:

At column 10, claim number 9, line number 27, change “on” to -- one --

Signed and Sealed this
Third Day of July, 2012

David J. Kappos

David J. Kappos
*Director of the United States Patent and Trademark Office*